US006877484B2

(12) United States Patent
Reiter

(10) Patent No.: US 6,877,484 B2
(45) Date of Patent: Apr. 12, 2005

(54) FUEL-INJECTION SYSTEM

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/465,961

(22) PCT Filed: Aug. 23, 2002

(86) PCT No.: PCT/DE02/03089

§ 371 (c)(1),
(2), (4) Date: Dec. 9, 2003

(87) PCT Pub. No.: WO03/046370

PCT Pub. Date: Jun. 5, 2003

(65) Prior Publication Data

US 2004/0079339 A1 Apr. 29, 2004

(30) Foreign Application Priority Data

Nov. 21, 2001 (DE) ..... 101 57 010

(51) Int. Cl.[7] ..... F02M 55/02
(52) U.S. Cl. ..... 123/468; 123/456
(58) Field of Search ..... 123/468, 456, 123/447

(56) References Cited

U.S. PATENT DOCUMENTS

| | | | | |
|---|---|---|---|---|
| 2,014,355 A | | 9/1935 | Hussman | |
| 4,295,452 A | * | 10/1981 | Lembke et al. | 123/470 |
| 4,872,471 A | * | 10/1989 | Schneider | 137/68.14 |
| 4,877,187 A | * | 10/1989 | Daly | 239/89 |
| 6,076,557 A | * | 6/2000 | Carney | 138/30 |
| 6,695,358 B2 | * | 2/2004 | Bonn | 285/13 |
| 2001/0009148 A1 | | 7/2001 | Asada et al. | |

FOREIGN PATENT DOCUMENTS

| | | |
|---|---|---|
| AT | 004 632 | 9/2001 |

* cited by examiner

*Primary Examiner*—Mahmoud Gimie
(74) *Attorney, Agent, or Firm*—Kenyon & Kenyon

(57) ABSTRACT

A fuel-injection system for the injection of fuel into an internal combustion engine includes at least one fuel injector and a fuel-distributor line as well as for each fuel injector a corrugated-tube bellows, which is able to be connected to an inflow section of the fuel injector. Deformation-energy absorbing elastomeric material abuts with an initial stress against at least some sections of the corrugated-tube bellows.

19 Claims, 1 Drawing Sheet

FUEL-INJECTION SYSTEM

FIELD OF THE INVENTION

The present invention relates to a fuel-injection system for injecting fuel into an internal combustion engine.

BACKGROUND INFORMATION

German Published Patent Application No. 28 29 057 describes a fuel-injection system which supplies fuel to a mixture-compressing internal combustion engine having external ignition as a function of operating parameters. The fuel-injection system encompasses a metal fuel-distributor line, which, via at least one branch line, is connected to at least one fuel injector, the branch line being embodied as a metal tube and connected to the fuel injector by manner of a threaded connection. Easily bendable metal is used as material for the branch line. Arranged between the threaded connection on the branch line and the fuel injector are thin-walled metal bellows in the form of a corrugated-tube bellows by which a lateral offset between the beginning of the branch line on the fuel-distributor line and the fitting position of the fuel injector is compensated; in addition, the operating noises emanating from the fuel injector are damped by the yielding of the bellows.

German Published Patent Application No. 28 29 057 describes a fuel-injection system such that while the flexurally soft bellows having thin material thickness does reduce a transmission of solid-borne noise to the fuel-distributor line, it is excited to oscillations itself and radiates noise. The natural resonance characteristic of the corrugated-tube bellows may be influenced only to a negligible degree. The corrugated-tube bellows, if it is made of an elastic sheet metal, has only low self-damping.

Finally, due to the vibrations of the internal combustion engine during operation, the corrugated-tube bellows are in danger of breaking or ripping if insufficient self-damping occurs. In the case of directly injecting fuel injectors and at the high pressures required in this context, the connection between a fuel injector and the fuel-distributor line is safety-relevant and must not break under any circumstances.

U.S. Pat. No. 2,014,355 describes a pipe connection in the form of a corrugated tube by which the transmission of vibrations is meant to be prevented or reduced. On the outside, the corrugated tube is surrounded by an envelope that does not touch the corrugated tube and is rigidly connected to one pipe section at one end. At its other end, the envelope is sealed from the other pipe section by a flexible seal, the envelope shielding from noise originating in the corrugated tube.

Other systems provide that the natural oscillation characteristic of the corrugated tube may not be influenced. The oscillation characteristic is merely influenced indirectly with respect to one another, via the stiffness of the two pipe sections, since these tube sections are damped in their relative movements via the sleeve and the seal. Moreover, the configuration consists of several parts and is complicated.

SUMMARY OF THE INVENTION

The fuel-injection system according to the present invention may provide that the natural resonance characteristic and the noise damping of the corrugated-tube bellows may be influenced to a wide extent. Also, the damping corrugated-tube bellows according to the present invention may be manufactured and adapted in its damping values in an uncomplicated and cost-effective manner. In addition, the tightness of the fuel-conveying components does not depend on the deformability of a seal, such as an O-ring seal. The safety, as it relates to a component malfunction during the service life, is increased.

Elastomeric rings are arranged, radially on the outside, in the inner folds of the corrugated-tube bellows.

This exemplary embodiment may be manufactured with O-rings, for example, and is able to be produced in a cost-effective manner. The inner folds are zones of great deformation during longitudinal oscillations of the corrugated-tube bellows. Elastomeric rings abutting there dampen these oscillations.

Alternatively, or in addition, an elastomeric hose may abut against the corrugated-tube bellows radially on the outside, this hose abutting solely against outer folds of the corrugated-tube bellows.

Only one additional component is mounted in the production. Since all outer folds are joined to each other in the longitudinal direction in a manner that provides damping, the damping is especially high.

Using a union nut, which presses a sealing cone radially against a cylinder section of the corrugated-tube bellows, the corrugated-tube bellows may be joined to the inflow section in a releasable manner.

As an alternative, the union nut sealingly presses a single fold of the corrugated-tube bellows against the inflow section.

DETAILED DESCRIPTION

Figure 1:
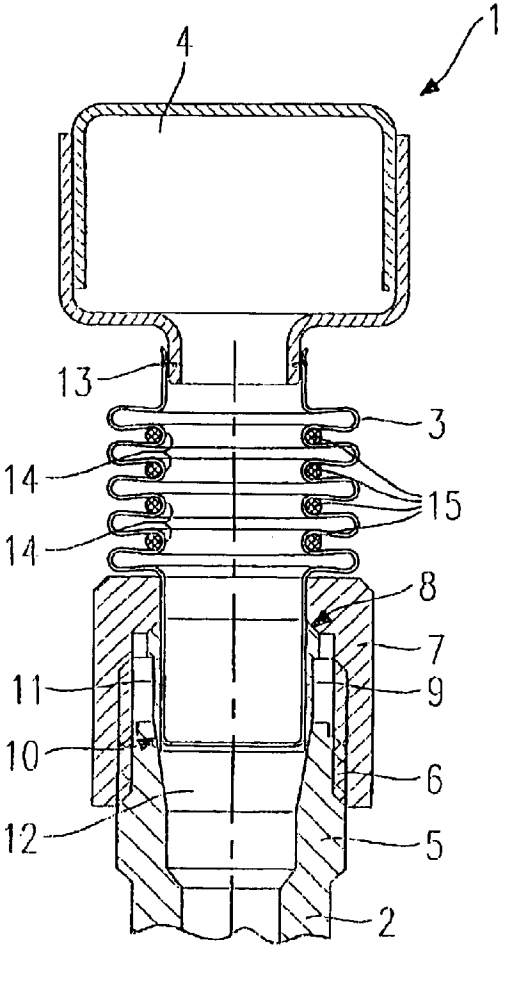
FIG. 1 shows a section through an exemplary embodiment of a fuel-injection system configured according to the present invention, in the sectional plane of a fuel injector and a corrugated-tube bellows of a fuel-distributor line.

FIG. 1 shows a section through an exemplary embodiment of a fuel-injection system 1 according to the present invention in the sectional plane of a fuel injector 2 and a corrugated-tube bellows 3 of a fuel-distributor line 4. Fuel injector 2 is shown only in the region of an inflow section 5, which is provided with a thread 6 for a union nut 7. When tightened, union nut 7 presses on an upper conical surface 8 of a sealing cone 9, which is moved into inflow section 5 by manner of a lower conical surface 10, thereby radially compressing sealing cone 9 and pressing it against a cylinder section 11 of corrugated-tube bellows 3. Due to the high surface pressure acting on lower conical surface 10 and on cylinder section 11, a fuel inflow 12 is sealed, without an elastomer coming into contact with the fuel.

At its other end, corrugated-tube bellows 3 is sealingly joined to fuel-distributor line 4 by a welded seam 13.

Inserted in inner folds 14 of corrugated-tube bellows 3, with an initial stress, are elastomeric rings 15, these elastomeric rings lying at the outside of corrugated-tube bellows 3, in the rounded grooves formed by inner folds 14, and are not in contact with the fuel.

If corrugated-tube bellows 3 is incited to expansions and contractions, especially in its longitudinal axis, by the vibrations occurring during operation of an internal combustion engine, elastomeric rings 15 absorb energy and damp this movement. The noise characteristic and the natural oscillation characteristic of corrugated-tube bellows 3 are thus influenced in an effective manner. This damping may be effected in a cost-effective manner. Above all, an adaptation is easily accomplished by using elastomeric rings 15 that have a different modulus of elasticity and/or by using a different number of elastomeric rings 15. For instance, only every second inner fold 14 may be provided with an elastomeric ring 15 in order to reduce the damping of corrugated-tube bellows 3.

Figure 2:
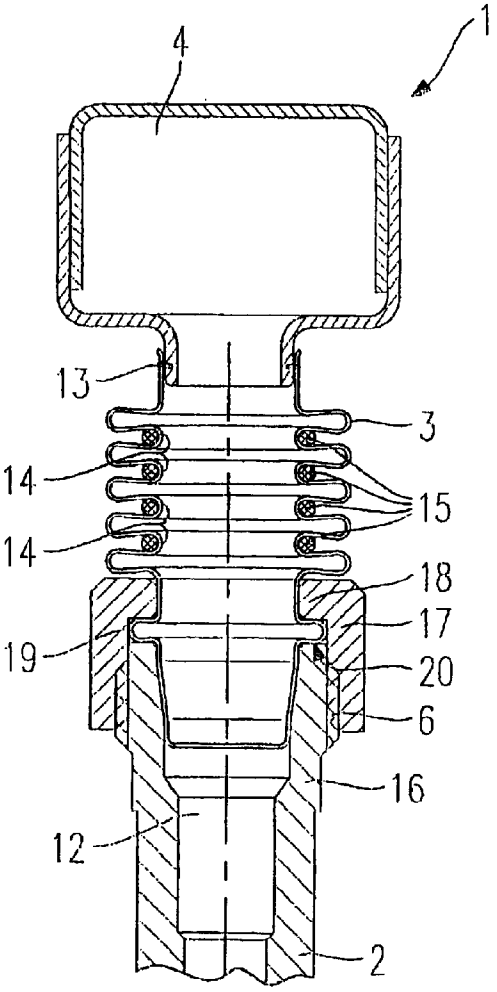
FIG. 2 shows an exemplary embodiment of a corrugated-tube bellows and an inflow section of a fuel injector in a sectioned view.

FIG. 2 shows a section through an exemplary embodiment of a fuel-injection system 1 configured according to the present invention. The exemplary embodiment deviates from the configuration in FIG. 1 only in the region of an inflow section 16 to fuel injector 2, and with respect to a union nut 17.

Identical components bear matching reference numerals. Shown is the sectional plane of fuel injector 2 and corrugated-tube bellows 3 as well as of fuel-distributor line 4.

Formed on inflow section 16 is thread 6 for union nut 17. Corrugated-tube bellows 3 is held in this position in that a flange 18 of union nut 17 presses an edge 19 against inflow section 16.

Fuel inflow 12 is sealed by the surface pressure of the edge in a sealing line 20 with respect to inflow section 16, without an elastomer coming into contact with the fuel.

At its other end, corrugated-tube bellows 3 is sealingly connected to fuel-distributor line 4 by a welded seam 13. Inserted with an initial stress in inner folds 14 of corrugated-tube bellows 3 are elastomeric rings 15.

This configuration effects a sealing and a releasable affixation of corrugated-tube bellows 3 on inflow section 16 of fuel injector 2 in an effective manner.

Figure 3:
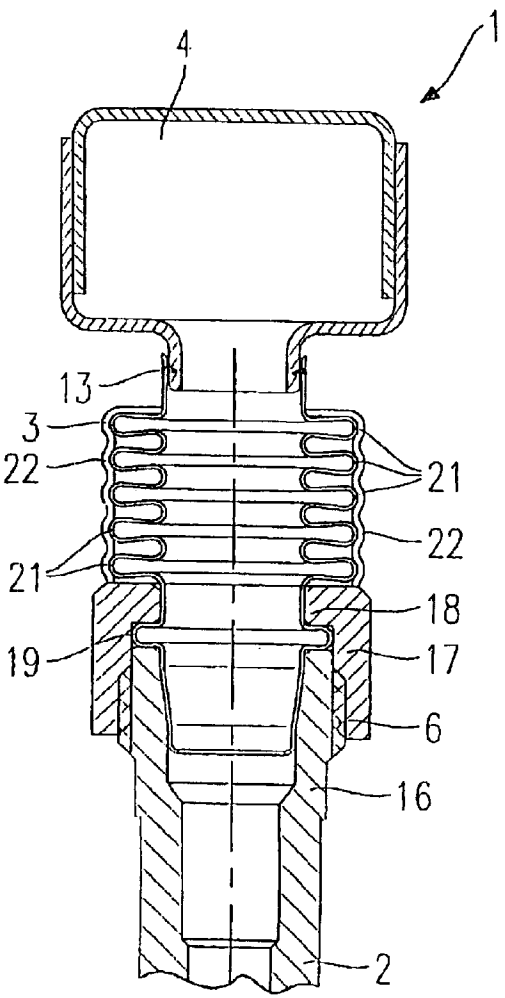
FIG. 3 shows an additional exemplary embodiment of a corrugated-tube bellows and an inflow section of a fuel injector in a sectioned view.

FIG. 3 shows another exemplary embodiment of the present invention. The configuration corresponds to that of FIG. 2, with the only difference that no elastomeric rings 15 are present, but a elastomeric hose 22 is used instead. Corrugated-tube bellows 3 and inflow section 16 of fuel injector 2 as well as fuel-distributor line 4 are shown in a sectional view. Union nut 17, which engages with thread 6 at inflow section 16, retains edge 19 of corrugated-tube bellows 3 at inflow section 16 by manner of flange 18.

At its other end, corrugated-tube bellows 3 is sealingly connected to fuel-distributor line 4 by a welded seam 13.

Elastomeric hose 22 is drawn over corrugated-tube bellows 3, for example by shrink-fitting a shrink tube. In an effective manner, elastomeric hose 22 also damps the relative movements of adjacent outer folds 21. In doing so, elastomeric hose 22 in each case abuts against corrugated-tube bellows 3 only in the region of outer folds 21.

Noise damping may thus be achieved in a cost-effective configuration.

It is also possible to provide elastomeric rings, as shown in FIGS. 1 and 2, in addition to elastomeric hose 22.

What is claimed is:

1. A fuel-injection system for injecting fuel into an internal combustion engine, comprising:

at least one fuel injector, a fuel-distributor line which includes, for each of the at least one fuel injector, a corrugated-tube bellows able to be connected to an inflow section of the at least one fuel injector; and deformation-absorbing elastomeric material which abuts with an initial stress against the corrugated-tube bellows at least in some sections; wherein:

the elastomeric material is in the form of a combination of an elastomeric hose that abuts against the corrugated-tube bellows radially on an outside of the corrugated-tube bellows, and a plurality of elastomeric rings arranged in inner folds of the corrugated-tube bellows radially on the outside of the corrugated-tube bellows.

2. The fuel-injection system of claim 1, wherein the elastomeric material is in a form of a plurality of elastomeric rings arranged in inner folds of the corrugated-tube bellows radially on an outside of the corrugated-tube bellows.

3. The fuel injection system of claim 1, wherein the elastomeric material is in a form of an elastomeric hose that abuts against the corrugated-tube bellows radially on an outside of the corrugated-tube bellows.

4. The fuel-injection system of claim 3, wherein the elastomeric hose abuts only against only outer folds of the corrugated-tube bellows.

5. The fuel-injection system of claim 3, wherein the corrugated-tube bellows is joined to the inflow section in a releasable manner via a union nut.

6. The fuel-injection system of claim 5, wherein the union nut is configured to press a sealing cone radially against a cylinder section of the corrugated-tube bellows.

7. The fuel-injection system of claim 5, wherein the union nut is configured to sealingly press an edge of the corrugated-tube bellows against the inflow section.

8. The fuel-injection system of claim 7, wherein the edge is one of a plurality of folds of the corrugated-tube bellows.

9. The fuel-injection system of claim 5, wherein the inflow section includes a thread for the union nut.

10. The fuel-injection system of claim 6, wherein:

the sealing cone includes a first conical surface and a second conical surface;

the union nut is configured to press on the first conical surface; and the sealing cone is configured to move into the inflow section via the second conical surface when the union nut presses on the first conical surface.

11. The fuel-injection system of claim 2, wherein the elastomeric rings are arranged in every second inner fold of the corrugated-tube bellows.

12. The fuel-injection system of claim 2, wherein the corrugated-tube bellows is joined to the inflow section in a releasable manner via a union nut.

13. The fuel-injection system of claim 12, wherein the union nut is configured to sealingly press an edge of the corrugated-tube bellows against the inflow section.

14. The fuel-injection system of claim 12, wherein the union nut is configured to press a sealing cone radially against a cylinder section of the corrugated-tube bellows.

15. The fuel-injection system of claim 14, wherein:

the sealing cone includes a first conical surface and a second conical surface;

the union nut is configured to press on the first conical surface; and the sealing cone is configured to move into the inflow section via the second conical surface when the union nut presses on the first conical surface.

16. The fuel-injection system of claim 12, wherein the inflow section includes a thread for the union nut.

17. The fuel-injection system of claim 1, wherein the corrugated-tube bellows is joined to the inflow section in a releasable manner via a union nut.

18. The fuel-injection system of claim 17, wherein the union nut is configured to press a sealing cone radially against a cylinder section of the corrugated-tube bellows.

19. The fuel-injection system of claim 17, wherein the union nut is configured to sealingly press an edge of the corrugated-tube bellows against the inflow section.

* * * * *